US007354408B2

(12) United States Patent
Muchisky

(10) Patent No.: US 7,354,408 B2
(45) Date of Patent: Apr. 8, 2008

(54) UNIVERSAL QUICK CHANGE APPLICATOR SYSTEM FOR MASSAGE APPARATUS

(76) Inventor: Thomas P. Muchisky, 26 Westwood Country Club, St. Louis, MO (US) 63131

( * ) Notice: Subject to any disclaimer, the term of this patent is extended or adjusted under 35 U.S.C. 154(b) by 338 days.

(21) Appl. No.: 10/818,639

(22) Filed: Apr. 6, 2004

(65) Prior Publication Data

US 2005/0222525 A1 Oct. 6, 2005

(51) Int. Cl.
*A61H 1/00* (2006.01)
*A61H 7/00* (2006.01)
*A61H 23/02* (2006.01)

(52) U.S. Cl. ..... 601/72; 601/46; 15/180; 15/230.19

(58) Field of Classification Search ..... 601/46, 601/69, 70, 72, 73, 85, 87, 101, 93, 80, 137, 601/138; 401/290, 207
See application file for complete search history.

(56) References Cited

U.S. PATENT DOCUMENTS 1,811,037 A * 6/1931 Albertson et al. ..... 15/180
2,605,490 A * 8/1952 Dolan ..... 15/180
3,081,479 A * 3/1963 Hanlon ..... 401/201
3,172,356 A * 3/1965 Vosburg ..... 401/207
4,098,266 A 7/1978 Muchisky et al.
4,102,334 A 7/1978 Muchisky
4,595,196 A 6/1986 Muchisky et al.
4,757,806 A 7/1988 Muchisky et al.
4,910,826 A * 3/1990 Rones ..... 15/230
4,919,117 A 4/1990 Muchisky et al.
5,001,804 A * 3/1991 Roeker et al. ..... 15/230.12
5,123,139 A * 6/1992 Leppert et al. ..... 15/230.17
5,187,827 A * 2/1993 Wei ..... 15/22.1
D367,712 S 3/1996 Young
D373,640 S 9/1996 Young
D437,713 S 2/2001 Young
D438,309 S 2/2001 Young
6,478,755 B2 11/2002 Young
6,735,808 B2 * 5/2004 Chen ..... 15/110
2004/0267170 A1 * 12/2004 Liste et al. ..... 601/17

FOREIGN PATENT DOCUMENTS

WO 03030807 A1 4/2003

* cited by examiner

*Primary Examiner*—Danton DeMille
(74) *Attorney, Agent, or Firm*—Polster, Lieder, Woodruff, Lucchesi, L.C.

(57) ABSTRACT

Apparatus for the quick and easy releasable attachment of any applicator to the operative head of any massage machine including a generally annular first plate threaded for permanent attachment to the massage machine head, the first plate including a series of openings formed therein and spaced at equal distances around the first plate, and a second plate for positioning on the top surface of the first plate and releasably attached to the base plate by hook and loop fastener, the second plate having the applicators attached at the top surface and including a series of studs spaced at equal distances around, and extending downward from, the bottom surface of the second plate so that the studs engage the openings in the first plate to appropriately align the first plate and the second plate and to resist dislodgement of the second plate, and the attached applicator, by eccentric forces incurred during use. The respective plates also can be provided sans openings and complementary studs with attachment of the two plates effected only by the hook and loop fastener. In either configuration, the applicator can be affixed to the second plate by direct bonding, by hook and loop fastener or by a threaded engagement.

19 Claims, 13 Drawing Sheets

UNIVERSAL QUICK CHANGE APPLICATOR SYSTEM FOR MASSAGE APPARATUS

CROSS-REFERENCE TO RELATED APPLICATIONS

Not applicable

STATEMENT REGARDING FEDERALLY SPONSORED RESEARCH OR DEVELOPMENT

Not applicable

BACKGROUND OF THE INVENTION

This disclosure relates generally to massage machines for the application of vibratory, oscillatory, gyratory and/or percussive forces to the body utilizing interchangeable force transmission applicators and, even more particularly, to a system to effect the quick and easy attachment and removal of force transmission applicators of a massage machine, and specifically to any existing massage machine used throughout the world.

The use of massage machines for imparting medical, health and/or beauty improvement benefits is known to the art. In general, these machines are used to apply vibratory, oscillatory, gyratory and/or percussive forces to the body for a variety of purposes, including but not limited to: to loosen bronchial secretions in the lungs; to improve blood circulation at epidural or somewhat deeper levels; to relax muscles; and/or to mobilize fluids in the presence of edema. Massage machines also are employed to promote feelings of well being, as is the case with manual massage. Illustrative embodiments of various massage apparatus are disclosed in U.S. Pat. Nos. 4,098,266; 4,991,117; 4,102,334; and U.S. Pat. No. 4,757,806, owned by the applicant or by companies owned or controlled by applicant.

Massage machines generally have an electric motor that transmits rotary motion to a cable, which is attached to a head assembly. The operative section of the head assembly incorporates an eccentric drive cam and drive plate attached to the cable so that the drive plate is moved in a gyratory motion by the cable and cam. A force transmitting applicator is screwed onto the drive plate of the operative section of the head assembly so as to be moved by the eccentric motion of the drive plate. The shape or configuration of force-transmitting applicators ("applicators") varies widely. While certain portions of any applicator configuration is determined by its purpose or use, the overall configuration is serendipitous and various manufactures employ a variety of over all design configurations even though the applicators may accomplish similar results in use. Applicators include, but are not limited to, a substantially circular flat pad, a multi-pronged pad, a curved sponge pad, a cone, or other specialized designs, such as the applicator unit disclosed in U.S. Pat. No. 4,102,334, used for directional stroking and tapotement of the body.

In order to increase the versatility of massage machines, the various applicators have been made to be interchangeable. Virtually all applicators have screw-thread fittings, to connect the applicator to the drive plate of the operative section of the head assemblies of a wide variety of massage machines. However, removing one applicator and replacing it with another is time consuming and awkward, due to the various applicator shapes, the thread design and shallow thread depth. Moreover, applicators can become "unscrewed" during use. Applicators are changed frequently, in order to provide varying treatments.

It would be advantageous, therefore, to provide an improved system that allows for the quick and easy changing of applicators attached to the operative section of the head assemblies of all known massage machines.

SUMMARY OF THE INVENTION

Preferred embodiments are described for the releasable attachment of an applicator to the operative section of the head assembly of a massage machine that facilitates quick and easy changing of applicators.

One aspect of the disclosure includes a base plate for threaded but usually permanent attachment to the drive plate of the operative part of a head assembly. The apparatus includes a second plate with any one of a variety of applicators secured to the top of said second plate. There is separable securing means on the top of the base plate and on the bottom of the second plate whereby the two plates are held together by the securing means during use, yet said second plate is quickly and easily separated from the base plate to allow changing of applicators.

In one aspect of the disclosure the securing means is hook and loop fastener.

In one aspect of the disclosure, the top of the second plate is adhered to the bottom of an applicator.

In another aspect of the disclosure, the top of the second plate is permanently attached to the bottom of an applicator.

In another aspect of the disclosure, the top of the second plate is removably attached to the bottom of an applicator.

In one aspect of the disclosure, the top of the second plate is secured to the bottom of an applicator by a threaded fitting.

In one aspect of the disclosure, the base plate has openings and the second plate has corresponding studs to engage the openings in order to resist dislodgement of an applicator from the base plate by eccentric forces generated during use. and easy attachment or removal of an applicator directly to the drive plate, rather than utilizing an intermediate base plate.

In another aspect of the disclosure a method of quickly and easily attaching and detaching an applicator on the operative part of the head assembly of a massage machine is provided.

DESCRIPTION OF THE PREFERRED EMBODIMENTS

Figure 1:
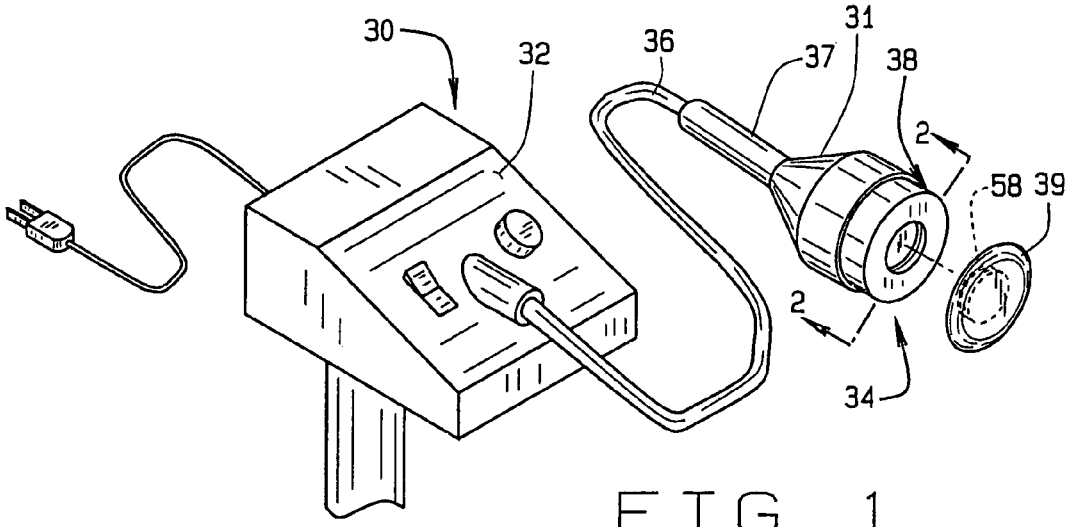
FIG. 1 is a partially exploded, perspective view of a representative embodiment of a massage machine.

The present disclosure provides an apparatus for the attachment of any existing applicator to the operative head of any existing massage machine, with a representative embodiment of a massage machine indicated generally by reference numeral 30 in FIG. 1. In general the massage machine 30 includes a power unit 32 and a head assembly 34 connected to the power unit by a transmission line 36. The head assembly 34 includes a handle 37 and an operative head, indicated generally by numeral 38. An applicator, shown by the representative embodiment of a pad applicator 39, is attached to the head in the conventional manner via screw threads. The applicator, whatever the configuration, is the part of the massage machine that is directly applied to the subject's body.

Figure 2:
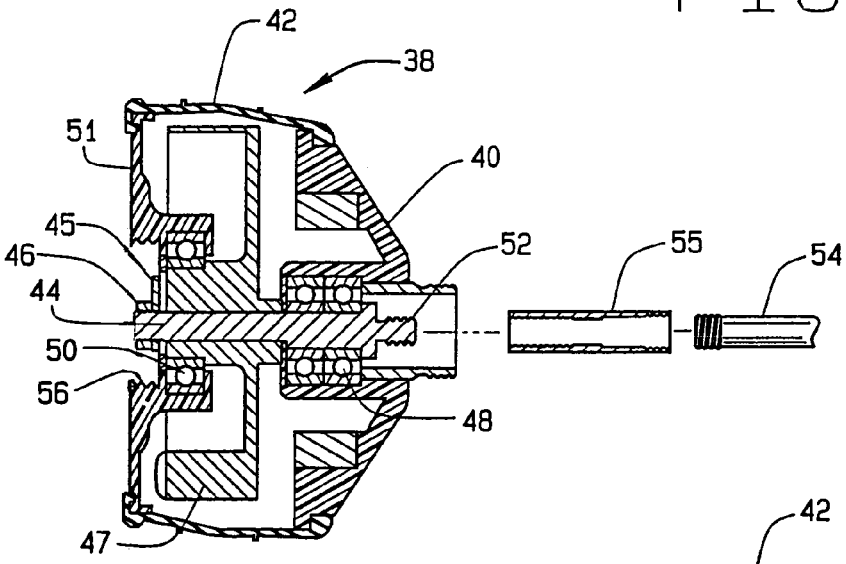
FIG. 2 is a cross-sectional view of a massage machine operative head taken across line 2-2 of FIG. 3.
Figure 3:
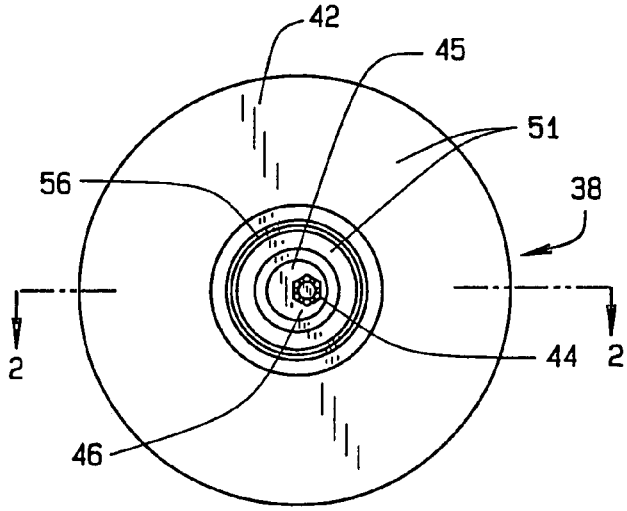
FIG. 3 is a plan view of the face of the massage machine operative head.

A general, representative embodiment of the operative part of head assembly 38 is shown in greater detail in FIGS. 2 and 3. In general, head 38 includes back 31, usually plastic and formed in an acceptable or desired external configuration, and a rubber boot 42. The plastic back cover plate 31 is not shown in FIG. 2. A shaft 44 extends through the head and is secured to an eccentric cam 45 by lock nut 46 and by a half-flat drive hole in the eccentric cam 45, which has a counter weight 47 mounted on the shaft. In the illustrative embodiment, the drive shaft 44 is journaled in bearings 48 at the aft end and journaled in bearings 50 in drive plate 51 at the fore end, via the eccentric cam 45. A threaded end 52 of shaft 44 is attached to a cable 54, which is the operative element in the transmission line 36, in this embodiment, by a coupler 55. The cable is operatively connected to power unit 32.

As understood in the art, the power unit drives cable 54, which rotates an eccentric cam 45 within the head to cause drive plate 51 to move in a gyratory motion. The cam is counterbalanced by counter weight 47 to produce a smooth gyratory motion. Although disclosing different configurations of massage machines, the general construction and principals of operation of massage machines is disclosed in the following patents, which are hereby incorporated by reference: U.S. Pat. Nos. 4,098,266; 4,102,334; and U.S. Pat. No. 4,757,806.

As seen in FIG. 3, head 38 includes centrally positioned internal threads 56 formed in the drive plate 51. Threads 56 are provided for the threaded attachment of an applicator. It will be appreciated by those skilled in the art that substantially all head and cable type massage machine applicators, despite the useful configuration, have screw-thread fittings, indicated generally by numeral 58 on the pad applicator 39. Heretofore, the screw fittings have existed as the means for attaching applicators to the head assemblies. The thread size and pitch is uniform among the various types and models of massage machines throughout the world.

The following detailed description of the present disclosure provides a significantly improved apparatus and method for attaching an applicator to a massage machine head assembly without restricting the continued usage of all existing applicators with the embodiments disclosed herein. The present disclosure provides a quick and easy means to convert all existing, in-use applicators and all existing, in-use massage machines throughout the world to a novel quick change applicator system.

Figure 4:
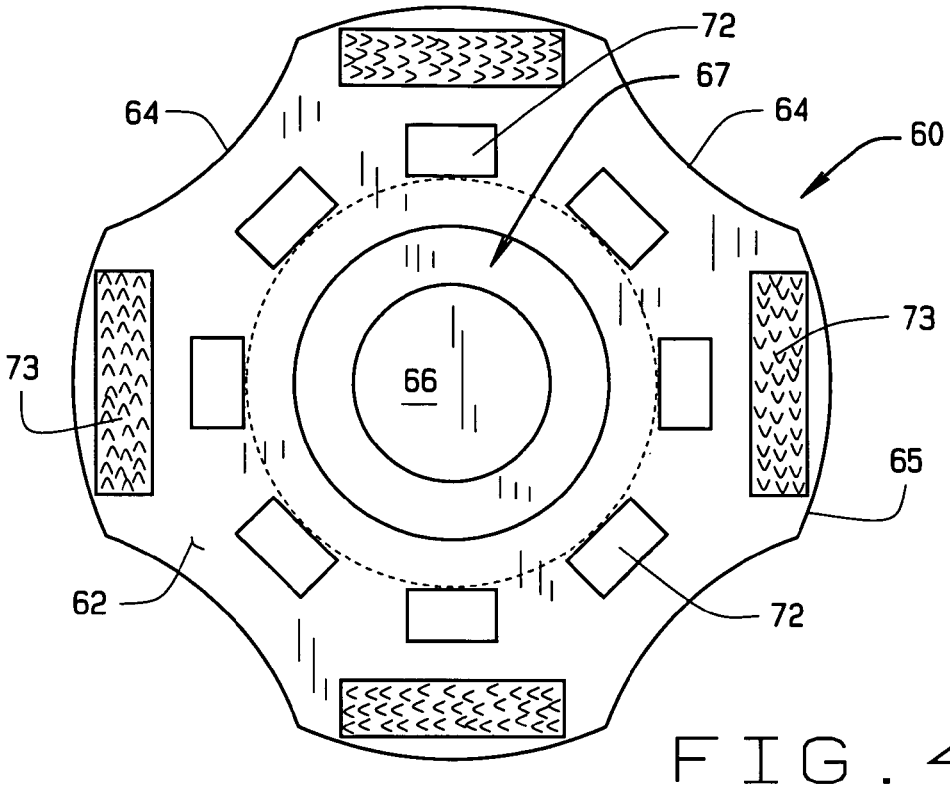
FIG. 4 is a top plan view of one embodiment of a base plate.
Figure 5A:
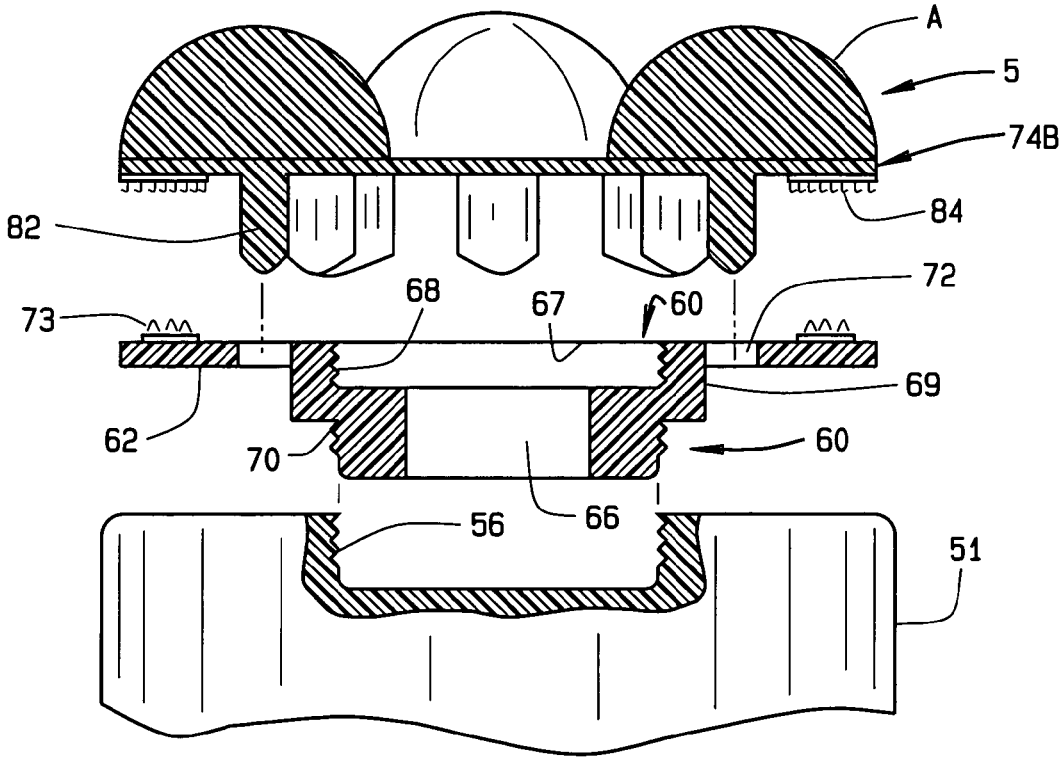
FIG. 5A is an exploded view, partially in cross-section, of a new style applicator, base plate and operative part of a massage machine head assembly employing one aspect of the quick release applicator attachment apparatus of the present disclosure.
Figure 5B:
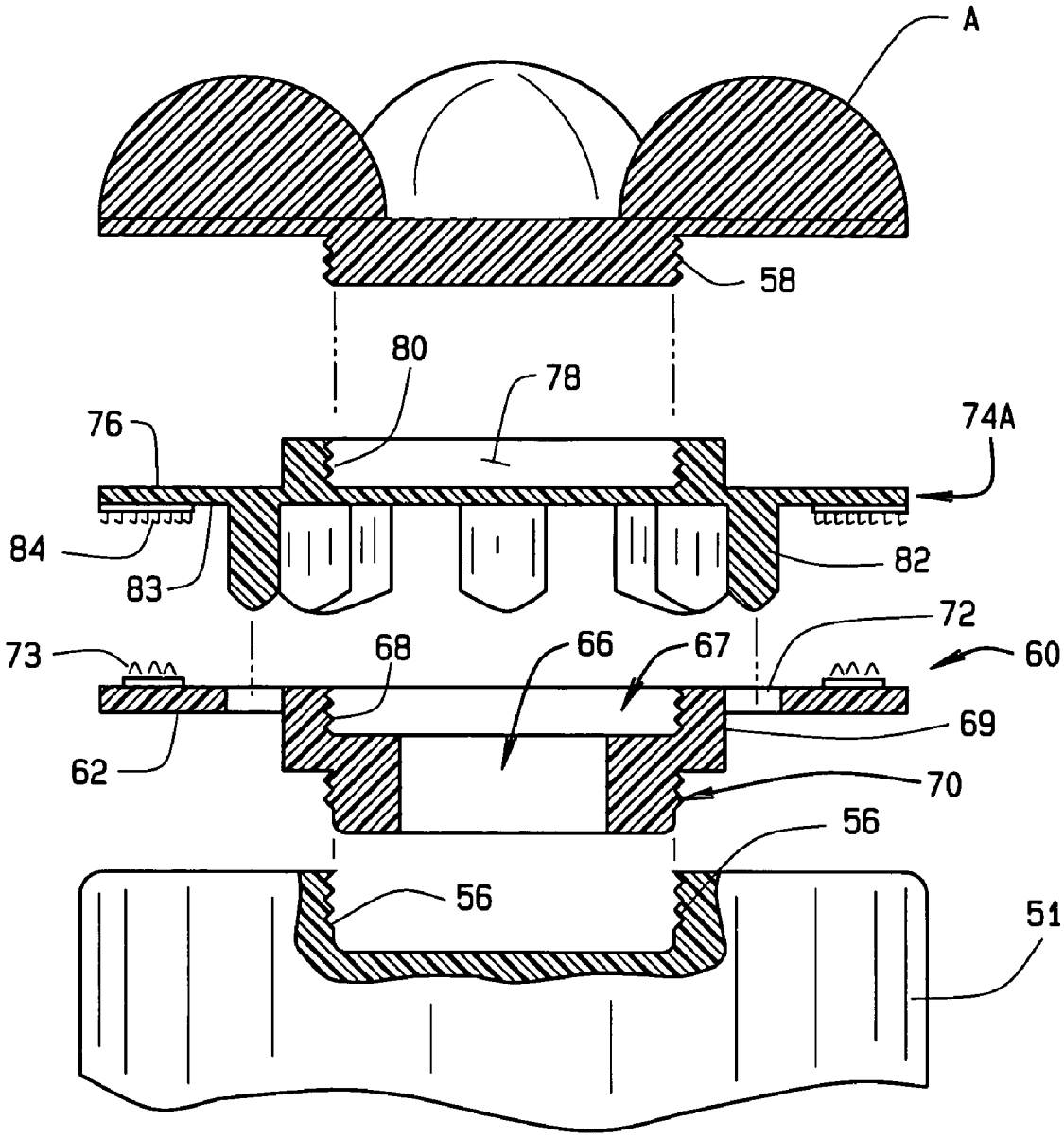
FIG. 5B is an exploded view, partially in cross-section, of a currently existing applicator and operative part of a massage machine head assembly employing another aspect of the quick release applicator attachment apparatus of the present disclosure.

Referring now to FIGS. 4 and 5A and 5B, one embodiment of the apparatus of the present includes a base plate 60. Base plate 60 includes a substantially flat body 62. A series of indentations 64 are formed in the peripheral edge 65 of the body, positioned equal distances apart. Indentions 64 allow the user to place his or her fingers under the applicator 5 mounted on a second plate that will be explained below, to facilitate pulling the applicators off the base plate 60, which is designed to remain permanently attached to the drive plate 51.

There is a centrally positioned, annular opening 66 formed through body 62, which allows access to the lock nut 46. There is countersunk circular recess 67 formed only partially through body 62 surrounding opening 66. As seen in FIGS. 5A and 5B, the opening 67 has internal threads 68. There is an externally threaded, screw-thread fitting 70 on the bottom side of base plate 60. There is an annular shoulder 69 between body 62 and fitting 70. Fitting 70 is appropriately sized and threaded so as to threadedly engage threads 56 in the drive plate 51. Consequently, base plate 60 can be threadedly attached to the massage machine head and tightened in place. Although it is recognized that base plate 60 could be removed by unscrewing, in the preferred embodiment it generally remains permanently attached to the head assembly, utilizing liquid cement added to screw thread fitting 70 for example.

Shoulder 69 functions as a spacer to provide clearance between the body of the base plate 60 and the face of drive plate 51 when the base plate 60 is attached. Furthermore, the base plate should be constructed from sufficiently stiff material so that the base plate does not contact the drive plate 51 or the rubber boot 42 anywhere except where the base plate is attached to the drive plate. It will be noted at this point that base plate 60 can remain in place for direct attachment of an applicator in the more traditional manner, if desired, by engaging the screw-thread fitting 58 of an applicator 39 (FIG. 1) with the internal threads 68 of the base plate 60.

In the embodiment illustrated in FIGS. 4-5B, base plate 60 has a series of openings 72 formed completely through the body and positioned at equal distances around annular recess 67. The openings can be positioned in any pattern around the base plate. As shown, the openings have a rectangular configuration, although the disclosure is not limited to openings having that configuration. There is an adherent 73 on the top surface of the base plate. For optimal performance of the apparatus, adherent 73 should be positioned at the outermost edge of the plate, as far as possible from the center of oscillation to maximize eccentric force resistance.

Figure 23:
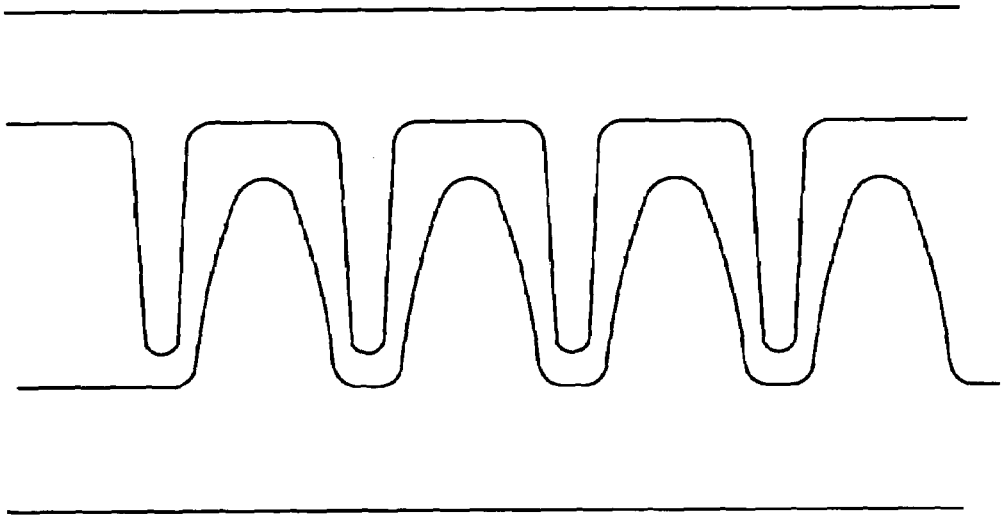
FIG. 23 is a second illustrative embodiment of an adherent used in the present disclosure.
Figure 24:
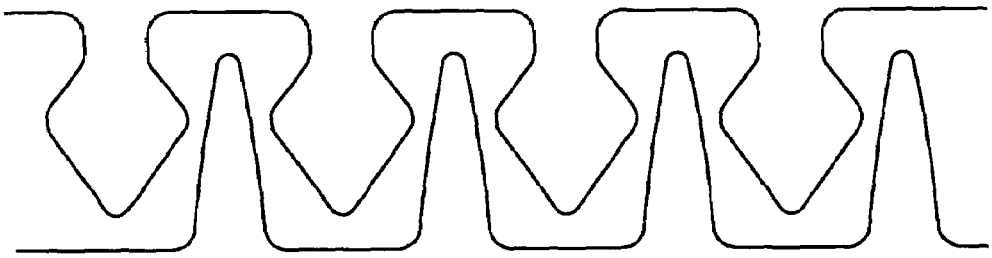
FIG. 24 is another illustrative embodiment of an adherent used in the present disclosure.
Figure 24A:
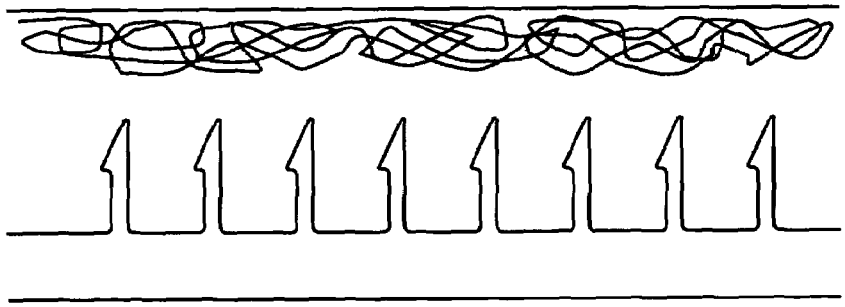
FIG. 24A is another illustrative embodiment of an adherent used in the present disclosure.
Figure 25:
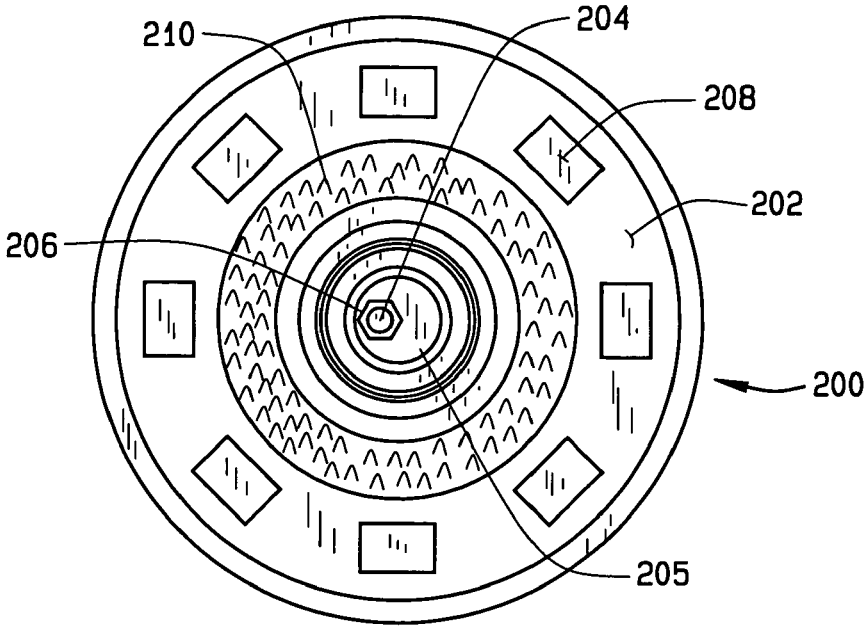
FIG. 25 is the top plan view of the operative part of a massage machine head assembly including a drive plate having features of a base plate of the present disclosure.

In the illustrated embodiment, the adherent is hook and loop fastener, commonly known as Velcro®. It will be understood that such hook and loop fastener is provided in opposed strips or sheets that adhere together, one strip bearing the hook portion and the other bearing the loop portion of the hook and loop fastener. It is also understood that the disclosure is not limited to hook and loop configurations, and alternative configurations are shown in FIGS. 23, 24 and 24A. These configurations are used to maximize horizontal holding forces while minimizing vertical holding forces, so that applicators can be easily lifted on and off of a base plate 60, but are immoveable when in operative use in the standard horizontal operative mode.

Adhere, as used herein, is intended to mean "to hold firmly" or "to stick fast" wherein "fast" is recognized as "held or caught firmly". (The Random House Dictionary, © 1978).) In any event, it is intended that "adhere" means holding two parts firmly together to the extent necessary to perform the desired function, yet not so firmly as to prevent a release of the adhered parts, when desired. "Adherent" is the means for accomplishing such. Consequently, although hook and loop fastener is the best mode of adherent presently known, the term is intended to include any means or material that accomplishes the same purpose, either known or foreseeable, such as releasable tacky tape, or unknown or unforeseeable system. Furthermore, when reference is made to hook and loop fastener, particularly in the appended claims, it is intended to mean either the hook side or the loop side or both, the combination of which forms the adherent.

The apparatus of the present disclosure also includes a second plate. FIGS. 5A-9 illustrate two aspects of second plate 74A and 74B. It will be noted that all currently existing applicators known worldwide can be attached to the second plate. It should be noted that all currently existing applicators A can be attached either directly to currently existing drive plates 51 or to base plate 60 or to second plate 74A.

Figure 6:
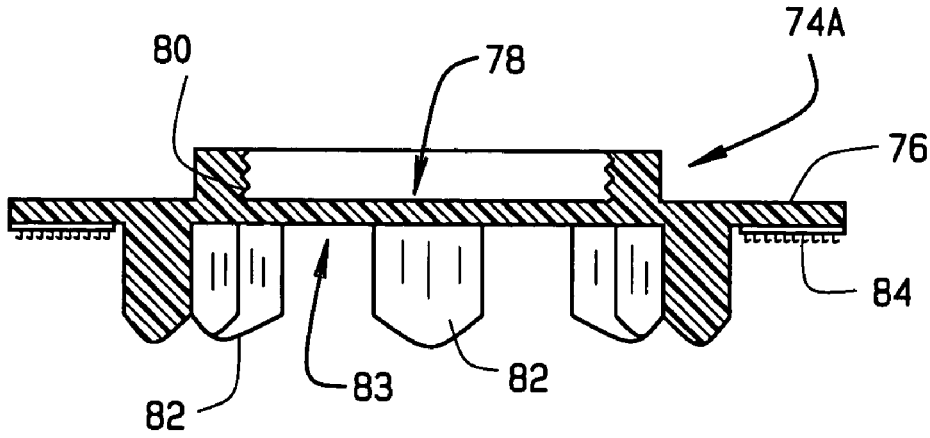
FIG. 6 is a side elevational view of one embodiment of a second adapter plate of the quick release applicator attachment apparatus.
Figure 7:
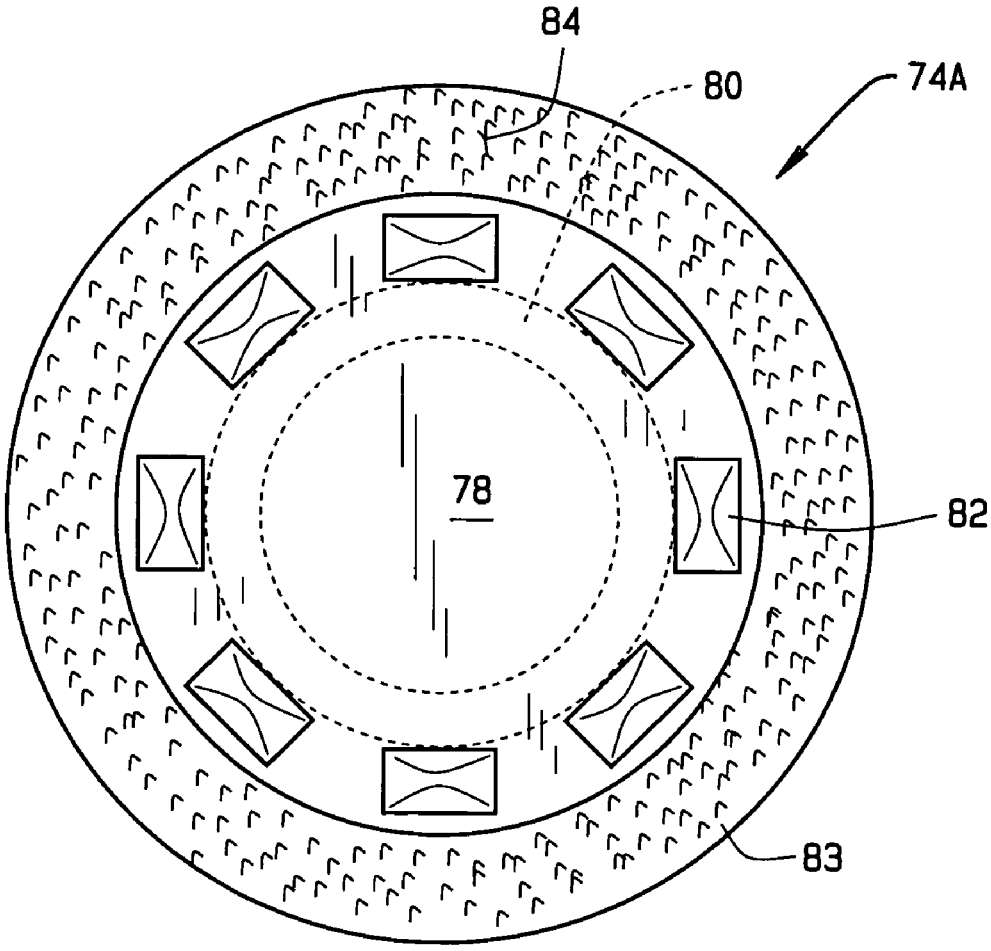
FIG. 7 is a bottom plan view thereof.

Referring to FIGS. 5B, 6 and 7, second plate 74A includes a substantially annular body 76 having a centrally positioned annular recess 78 formed partially through body 76. There is an internally threaded screw-thread fitting 80 at the top of body 76, surrounding recess 78. Fitting 80 is threaded so as to threadedly engage the screw-thread fitting 58 on a conventional applicator 39. Consequently, the illustrated plate 74A allows the use of the novel attachment apparatus with any existing applicator. This design imparts substantial versatility to the device in that it can be used with all existing, unmodified applicators throughout the world.

Plate 74A includes a series of depending studs 82 on the bottom side 83 of the plate body. It will be understood that the studs are positioned, configured with a rectangular cross-section, are drawn to a dull point and sized so as to engage openings 72 in base plate 60 in a snug friction fit. The bottom surface of second plate 74A has an adherent 84 extending around the perimeter of the plate in an uninterrupted pattern. Although adherent 84 can be any adherent, as defined above, in a preferred aspect of the disclosure, adherent 84 also is hook and loop fastener. Hence, in this embodiment, the adherent on the second plate can be either the hook portion or the loop portion, with the opposite thereof being found on the corresponding base plate. The adherent employed preferably is one designed for maximum shear resistance in the horizontal plane, with minimal vertical resistance, in order to facilitate separation of the plates when attached together. The adherent is placed at the peripheral edge of the plate.

Figure 8:
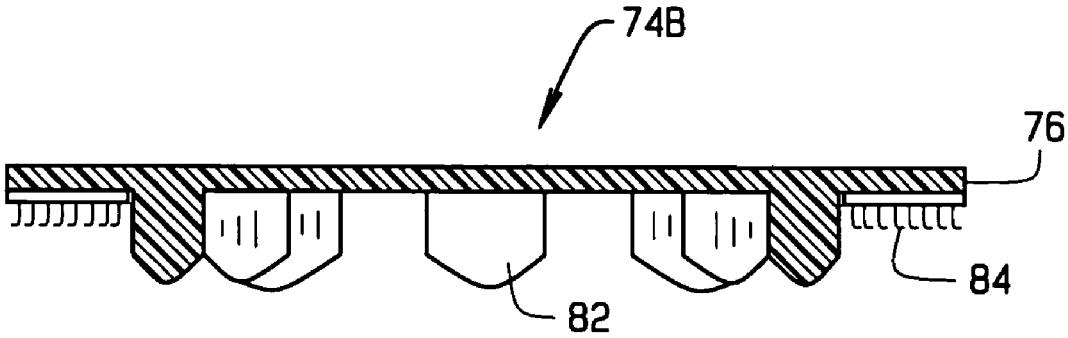
FIG. 8 is a side elevational view of one embodiment of a second plate of the quick release applicator attachment apparatus.
Figure 9:
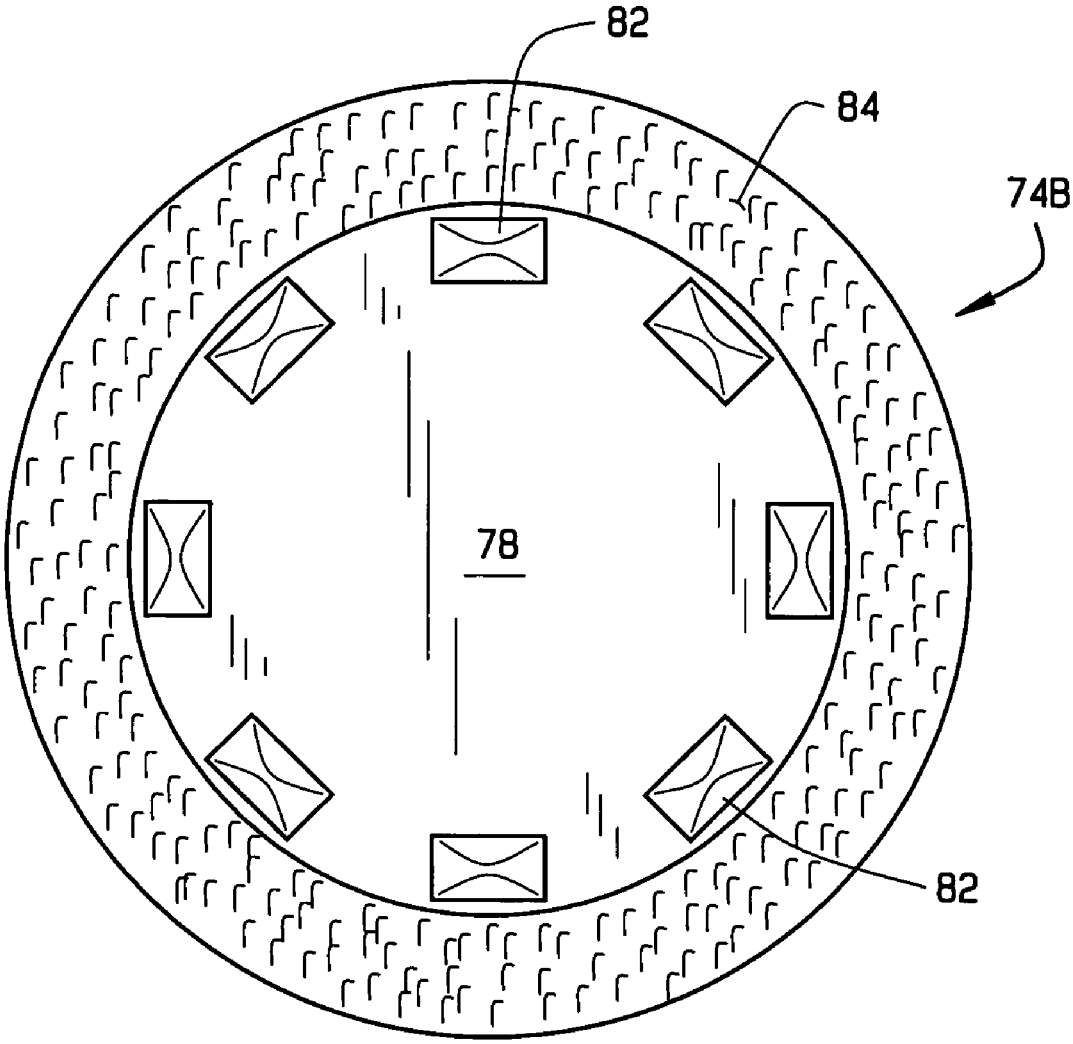
FIG. 9 is a bottom plan view thereof.
Figure 10:
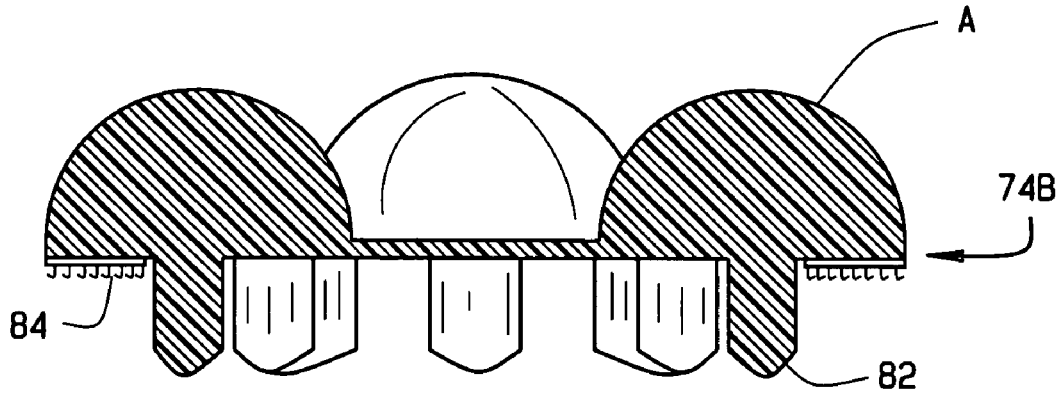
FIG. 10 is a side elevational view of a representative embodiment of an applicator with the second plate of FIG. 8 attached thereto.
Figure 11:
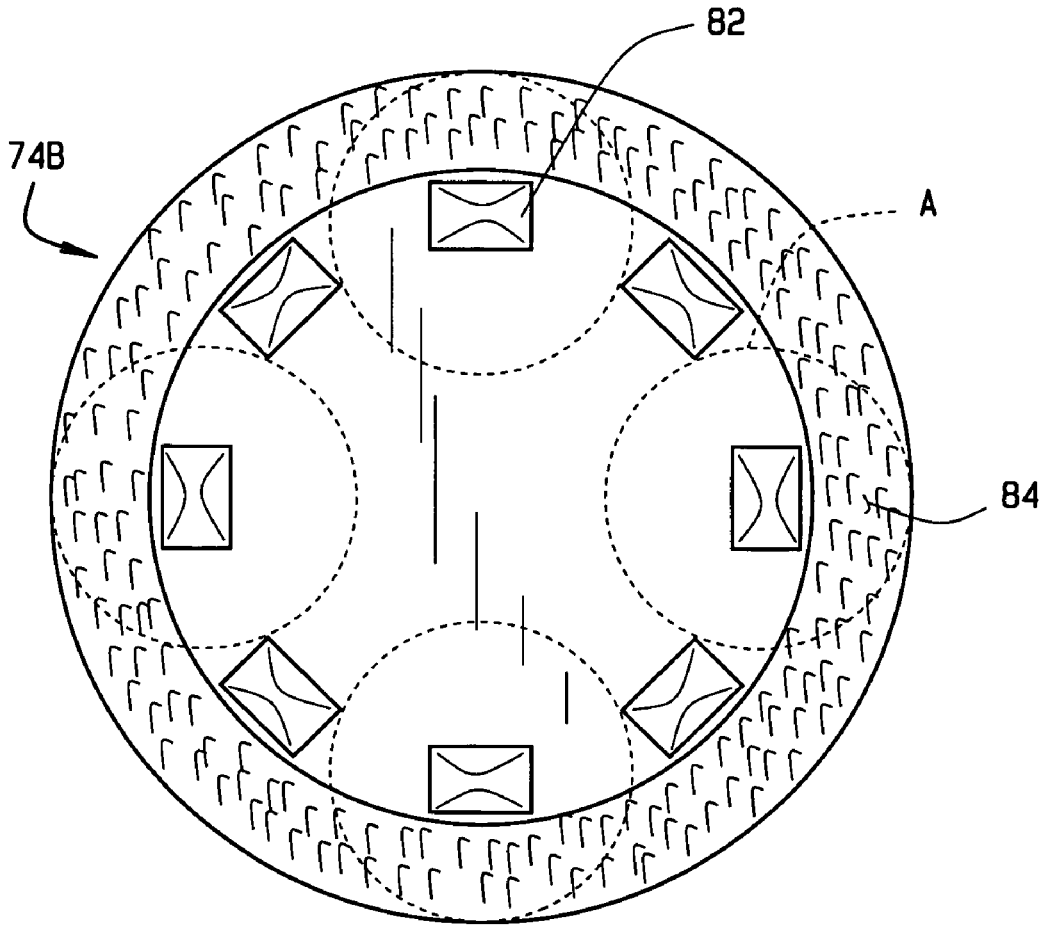
FIG. 11 is a bottom plan view thereof.

The second plate 74B shown in FIGS. 5A, 8 and 9 is constructed similarly to the previously described second plate 74A. Plate 74B includes the depending studs 82 as well as the adherent 84 around the extreme peripheral edge of the bottom surface of the plate. However, this second plate does not include a screw-thread fitting on the top side of body 76. Plate 74B is intended to be attached directly and generally permanently to the bottom surface of an applicator A, as shown in FIGS. 10 and 11. Consequently, it is generally flat and has no opening formed in the center. By attached, it is intended to include bonded, glued, attached by screws or rivets or any other way of attaching the plate to the applicator that is relatively permanent, that is, not intended to be disassembled in normal use. In this embodiment, therefore, the applicators are provided with the second plate 74B attached, which offers the advantages of not having to attach an applicator to the second plate.

It will be understood that a third way of attaching an applicator to a second plate includes a removable attachment by an adherent, such as hook and loop fastener, particularly an adherent that can withstand shear forces but succumbs to vertical pulling forces for removal of the plate from the applicator.

In any event, the two assemblies illustrated in FIGS. 5A and 5B allow for the quick release and quick attachment of an applicator to the head of a massage machine. The base plate 60 is installed as described. In regards to the embodiment of FIG. 5A, an applicator A, with the second plate 74B attached, is positioned on the base plate. The studs function to align the two plates and the hook and loop fasteners 73 and 84 secures the plates together, thereby attaching the applicator to the head.

In regards to the embodiment of FIG. 5B, the base plate 60 is installed as described. The second plate 74A is attached to the bottom of the applicator A by screwing the applicator into fitting 80, and the combination secured to the base plate for use.

Figure 12:
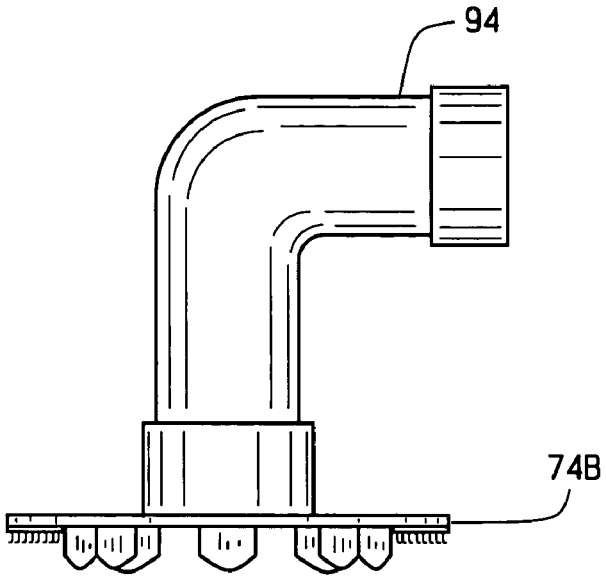
FIG. 12 is a side elevational view of another representative embodiment of a right angle applicator with the applicator with the second plate of FIG. 8 attached thereto.
Figure 13:
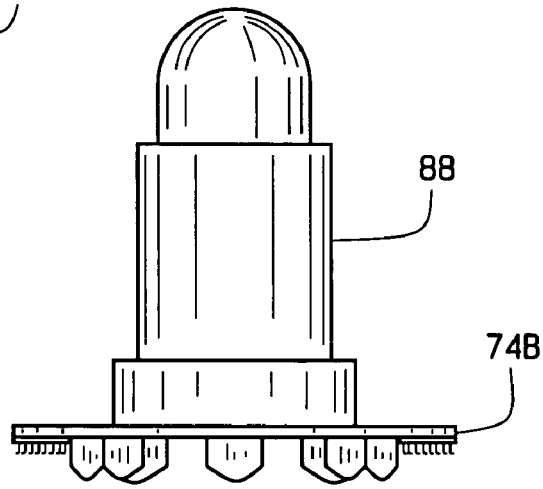
FIG. 13 is a side elevational view of another representative embodiment of a blunt tip applicator with the second plate of FIG. 8 attached thereto.
Figure 14:
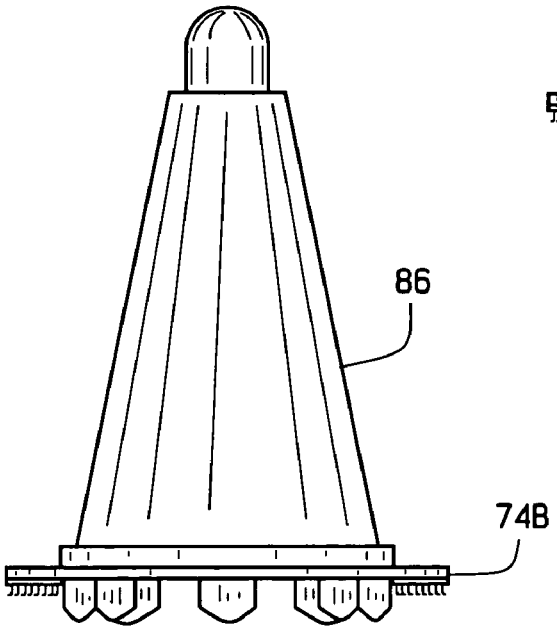
FIG. 14 is a side elevational view of another representative embodiment of a pointed tip applicator with the second plate of FIG. 8 attached thereto.
Figure 15:
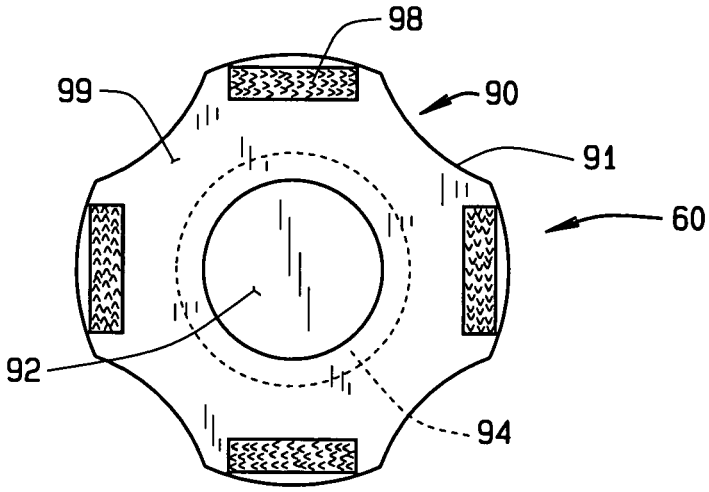
FIG. 15 is a top plan view of another embodiment of a base plate.

It will be noted that the attachment apparatus just described having the stud and opening arrangement functions exceptionally well for applicators that have substantial length or height, since these types of applicators tend to generate eccentric forces on the head assembly. The combination of the hook and loop fastener with the studs engaged in the base plate openings, resists the eccentric forces that could tear free the applicator from the operative head. FIGS. 12-14 illustrate representative embodiments of such higher profile applicators directly attached to a second plate 74B.

FIG. 12 shows a specialized accessory 84 used for directional stroking, percussion and tapotement on the body surface. FIG. 14 illustrates a second plate 74B attached to a plastic cone 88 with a rubber tip, generally used to reduce trigger points or for reflexology. FIG. 13 illustrates another style of cone 88, generally used to provide more gentle stimulation than cone 86.

It will be understood that it is also intended for the second plate 74A of FIG. 6 to be used with illustrative higher profile applicators, although not specifically illustrated as such. In that situation, the applicator is attached to plate 74A by threadedly engaging the applicator with fitting 80.

Figure 16:
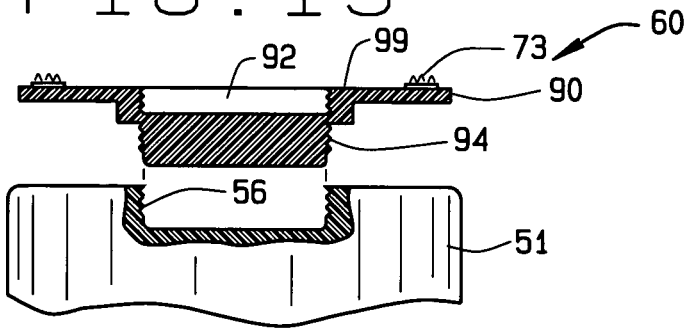
FIG. 16 is an exploded view of the base plate of FIG. 15 for attachment to the operative part of a head assembly.
Figure 17:
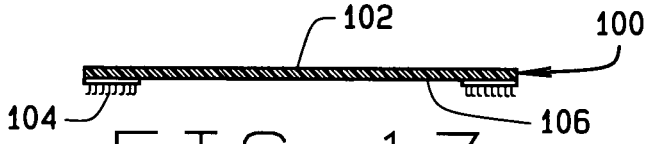
FIG. 17 is a side elevational view of another embodiment of a second plate.
Figure 18:
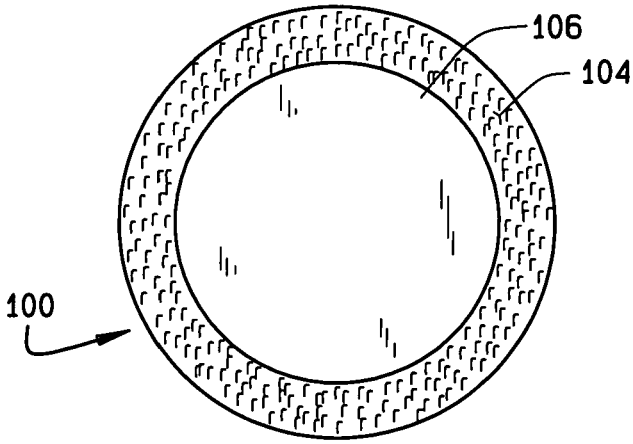
FIG. 18 is a bottom plan view thereof.

FIGS. 15-22 illustrate the construction and use of another illustrative embodiment of the apparatus of the present disclosure. As shown, this embodiment includes a base plate 60 having a body 90 with an annular partial opening 92, a threaded fitting 94 on the bottom and gripping indentations 91 spaced around the periphery. Fitting 94 is designed to threadedly engage threads 56 of drive plate 51, as seen in FIG. 16. There are strips of adherent 73 on the top surface 99 of the base plate. In the illustrated embodiment hook and loop fastener are positioned around the perimeter of the body.

Figure 19:
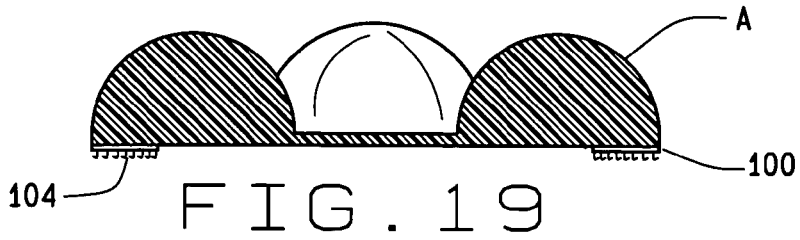
FIG. 19 is a side elevational view of the a representative embodiment of an applicator with the second plate of FIG. 17 permanently attached thereto.
Figure 20:
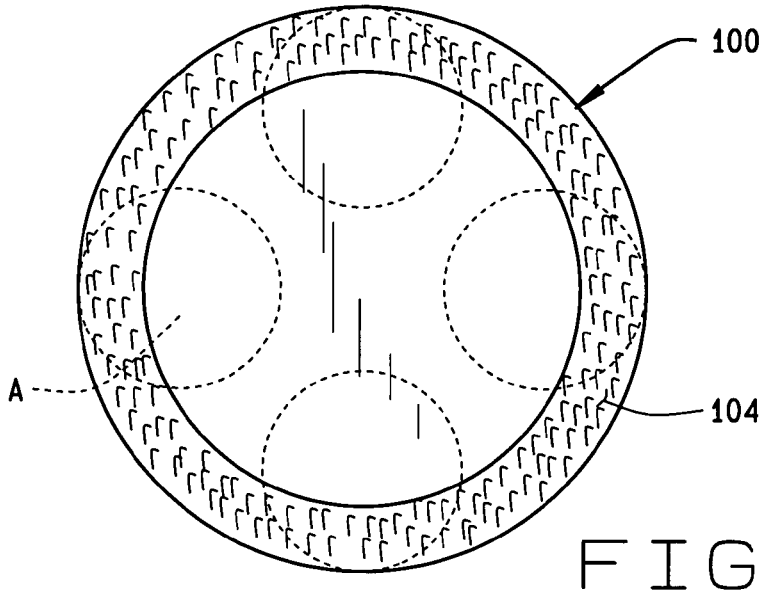
FIG. 20 is a bottom plan view thereof.

The apparatus of FIGS. 15-22 also include a plate 100, having a circular configuration. As shown, plate 100 has hook and loop fastener 104 extending around the extreme perimeter of the bottom surface 106. As shown in FIGS. 19 and 20, the top side of plate 100 is intended to permanently affix or attach to the bottom surface of an applicator A.

Figure 21:
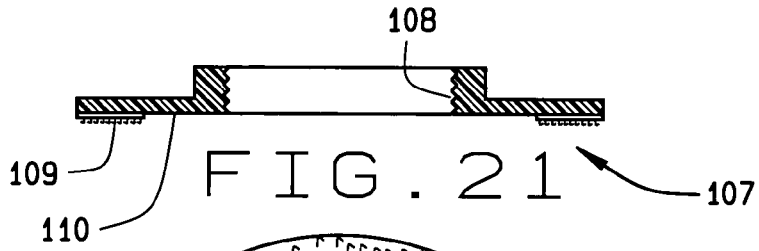
FIG. 21 is a side elevational view of another embodiment of a second adapter plate.
Figure 22:
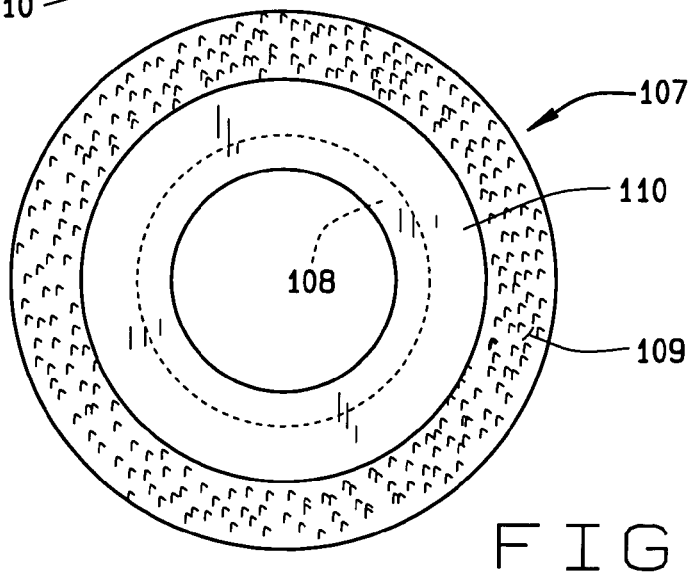
FIG. 22 is a bottom plan view thereof.

An alternative configuration of a second plate 107, shown in FIGS. 21 and 22, includes an internally threaded fitting 108 extending through the second plate 107 so that a conventional, i.e. threaded, applicator can be attached to the second plate. Second plate 107 also bears an adherent 109 around the peripheral edge of the bottom surface 110. In any event, the apparatus of FIGS. 15-22 operate similarly to those previously described. However, because there is no stud and opening arrangement between the plates, the second plate, with its attached applicator, is secured to the base plate by the adherent, thereby providing for quick and easy removal and reattachment of applicators. These designs function well when used with low profile applicators, such as the 4-ball applicator A shown or a pad or the like.

Figure 26:
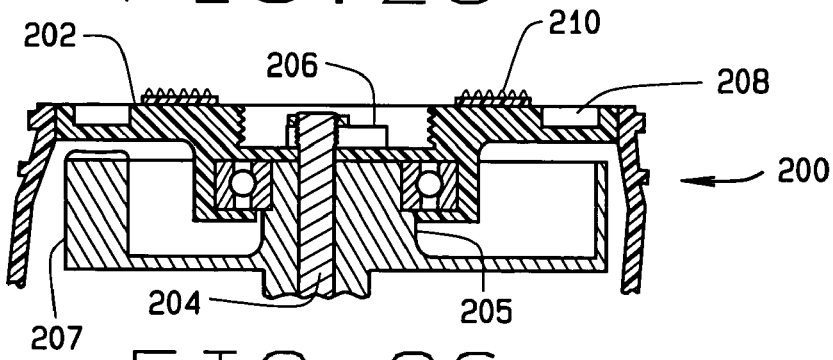
FIG. 26 is a cross-sectional view of the operative part of a massage machine head assembly including the drive plate of FIG. 25.

FIGS. 25 through 28 illustrate alternative embodiments of a quick release applicator assembly of the present disclosure. The illustrated embodiments are intended to be used with a massage machine head, indicated generally by reference numeral 200 as original equipment. As shown, the construction of head assembly 200 is generally the same as that described above. However, head assembly 200 is provided with a redesigned drive plate 202 that also functions like a base plate, to accommodate the quick and easy changing of an applicator without the need for adding a base plate 60 to the currently designed drive plate 51. As shown in FIG. 26, a shaft 204 extends through the head and is secured to an eccentric cam 205 by lock nut 206. The eccentric cam 205 also incorporates counter weight 207. The shaft is driven, as previously described, moving drive plate 202 in a gyratory or oscillatory manner.

Drive plate 202 includes a plurality of recesses 208 formed therein and, in the embodiment illustrated, equally spaced around the perimeter of the plate. Drive plate 202 includes adherent 210, such as the previously described hook and loop fastener on the surface, positioned inwardly from recesses 206.

Figure 27:
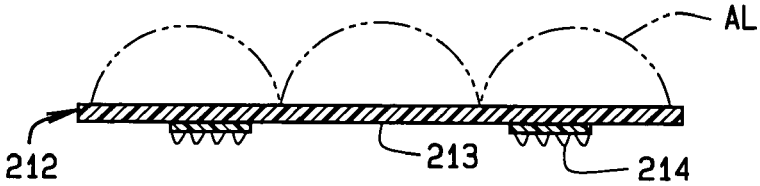
FIG. 27 is an illustrative embodiment of a second plate to be affixed to the bottom of an applicator.
Figure 28:
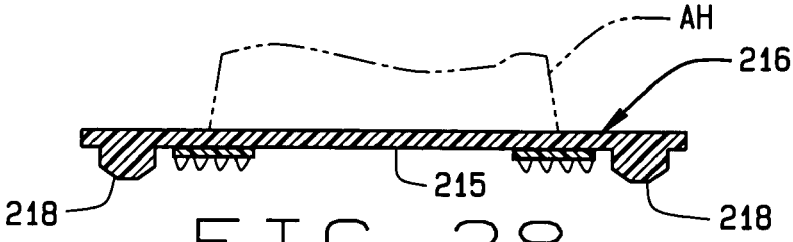
FIG. 28 is an illustrative embodiment of a second plate for use with taller applicators.

Drive plate 202 is intended to be used with applicators employing second plates of the embodiments illustrated in FIGS. 27 and 28. Applicator AL in FIG. 27 is a lower profile, four-ball design. As illustrated, a second plate 212 is permanently attached to the bottom surface of the applicator. Second plate 212 is similar in construction to those described above; however, it includes a bottom surface 213 with an adherent 214 positioned inwardly from the perimeter of the plate rather than around the circumference of the plate, so as that it will align with adherent 210 of drive plate 202. As shown, second plate 212 does not include studs on the lower level and is intended to be used with the low profile applicators AL.

FIG. 28 illustrates an alternative embodiment of a second plate 216 affixed to the bottom of a higher profile applicator AH. Second plate 216 includes a bottom surface 215 with plurality of studs 218 extending down from the bottom and positioned equidistantly around the perimeter of the plate so as to align with recesses 208 in drive plate 202. It will be noted that studs 218 are shorter than the previously described studs. The studs are designed to engage and seat in recesses 208, without passing completely through the redesigned drive plate 202.

The shorter stud and recess arrangement is used rather than longer studs, which would ordinarily extending through openings formed in a base plate because the studs cannot extend through drive plate 202 due to the limited clearance required to allow drive plate 202 to function. However, the shorter studs 218 still provide equivalent resistance to eccentric forces when second plate 216 is attached to a higher profile applicator AH because of the placement of studs 218 farther from the center of gyration of the head assembly.

Figure 29A:
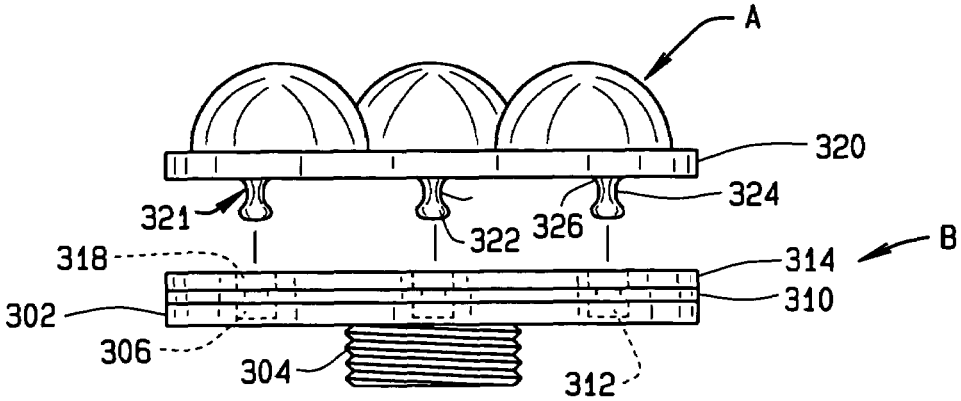
FIG. 29A is an illustrative embodiment of a second plate with an applicator attached thereto positioned over an illustrative embodiment of a base plate.
Figure 29B:
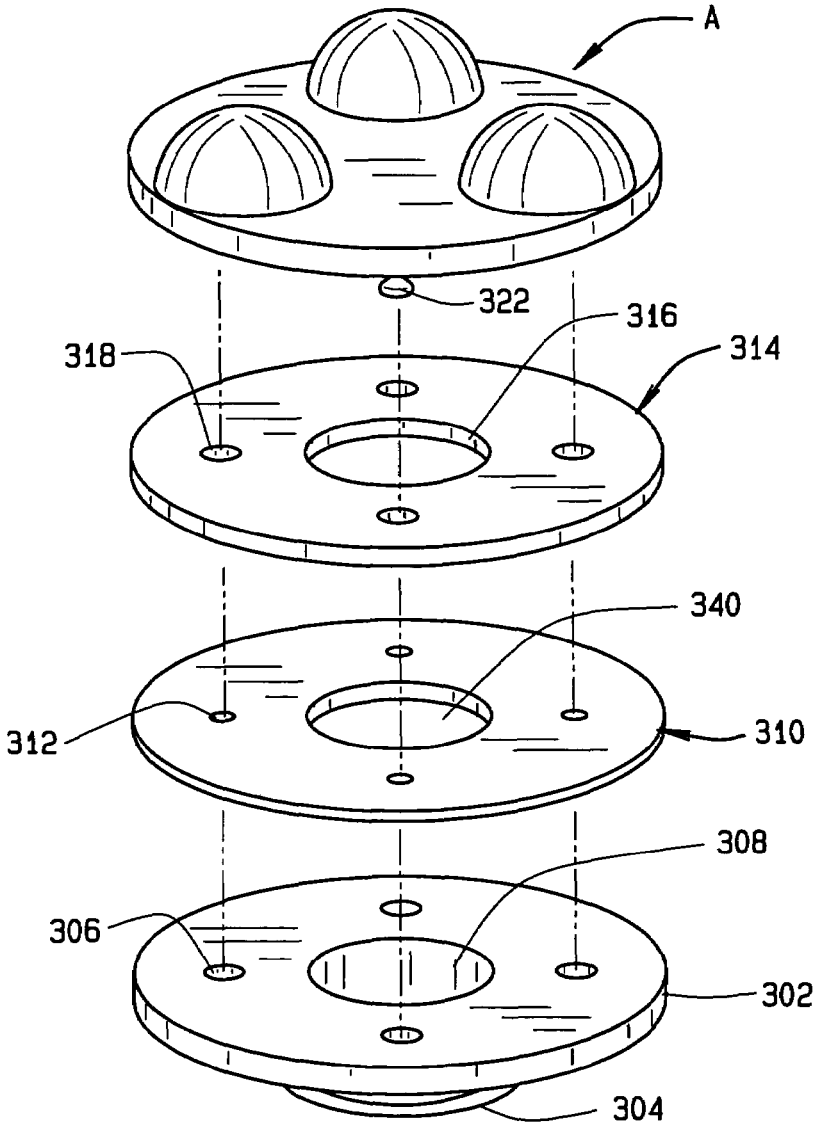
FIG. 29B is an exploded view of the apparatus of FIG. 29A.

FIGS. 29 and 29A illustrate another embodiment of the disclosure, indicated generally be reference numeral 300. Apparatus 300 includes a base plate 302 with a threaded fitting 304 for the threaded attachment of the base plate to a drive plate 51. Base plate 302 has a series of opening or holes 306 formed therethrough and positioned equidistance apart around the plate. In the illustrated embodiment, base plate 302 includes four holes. There is a central opening 308 in base plate to allow access, as set out above in reference to other embodiments.

A diaphragm 310 is positioned on the top surface of base plate 302. Diaphragm 310 is constructed from a resilient, deformable material, such as rubber. There are a series of holes 312 formed in diaphragm 310 and positioned so as to align with the openings or holes 306 in base plate 302. It will be noted that the diameter of holes 312 is substantially less than that of holes 306. In any event, diaphragm 310 is affixed to base plate 302, generally be gluing or other adhesive. There is a central hole 340 in the diaphragm 310, to allow access, as set out above in reference to other embodiments. A rigid upper plate 314 is positioned on top of diaphragm 310 and secured, again by adhesive or the like. Upper plate 314 has a central opening 316 and a series of openings or holes 318 positioned around the plate. Holes 318 are positioned so as to align with holes 312 and 306 and are of a greater diameter than holes 312.

Apparatus 300 includes an applicator plate 320. The applicator plate 320 is analogous to the previously described second plates, but referred to in this embodiment as the applicator plate so as to avoid confusion with the upper plate 314. Applicator plate 320 includes an upper surface on which an applicator A is permanently affixed. There is a series of buttons 321 depending from the bottom side of applicator plate 320. Buttons 321 include a bulbous head 322, a narrow shank 324 and a pedestal 326 that adjoins plate. It will be noted that buttons 321 are positioned around the bottom of applicator plate 320 so as to align with the recited holes in each of the base plate, the diaphragm and the upper plate. Bulbous head 322 has an appropriate circumference to allow it to pass through holes 318 in the upper plate. However, the circumference of bulbous head 322 is greater than that of holes 312 in diaphragm 310.

Hence, to attached applicator A, applicator plate 320 is positioned over the upper plate 314 and buttons 321 aligned with holes 318. Vertical downward pressure is exerted on the applicator until bulbous head 322 stretches holes 312 so as to penetrate or pop through the diaphragm. The resilient diaphragm regains its original shape so that the perimeter of holes 312 encircle and compress around shank 324 of button 321, with the bulbous head 322 below the diaphragm. Thus, diaphragm 310 holds applicator plate 320, with its attached applicator A in place by gripping buttons 321. It will be noted that the bulbous heads 322 can extend into openings 306 in base plate 302. To remove applicator A, from holes 312, the user grasps plate 320 and exerts sufficient vertical force to extract buttons 321 from holes 312. Because the buttons 321 are introduced through rigid upper plate 314 and base plate 302, applicator plate 320 is resistant to shear from oscillatory or gyratory forces.

Figure 30A:
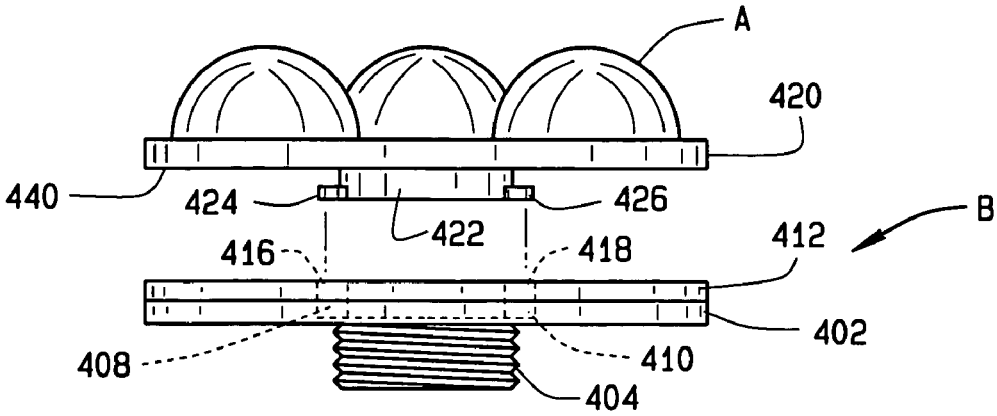
FIG. 30A is an illustrative embodiment of a second plate with an applicator attached thereto positioned above an alternative embodiment of a base plate.
Figure 30B:
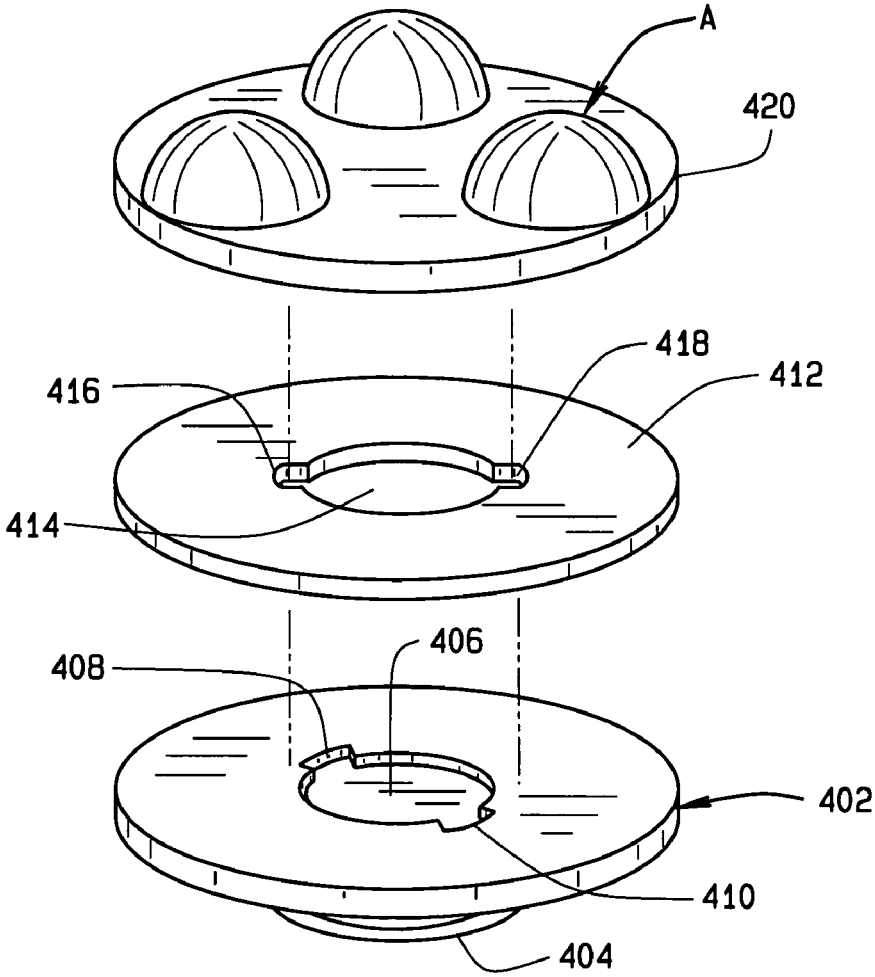
FIG. 30B is an exploded view of the apparatus of FIG. 30A.

FIGS. 30 and 30A illustrate yet another apparatus of the present disclosure, indicated generally by reference numeral 400. Apparatus 400 includes a base plate 402 with an externally threaded fitting 404. Base plate 402 also includes a central, substantially circular opening 406 descending partially through base plate 420, and has a pair of opposed cutouts 408 and 410 in its perimeter, which effectively create a keyhole in the center of plate. Base plate 402 is designed to threadedly attach to the operative part of a massage machine head assembly, as previously described.

An upper plate 412 is positioned on top of base plate 402 and affixed thereto. Upper plate 412 has a central, generally circular opening 414 that also includes a pair of opposed cutouts 416, 418 in its perimeter. It will be noted that cutouts 416 and 418 are complementary to, but smaller than, cutouts 408 and 410, respectively.

Apparatus 400 includes an applicator plate 420 with an applicator A affixed to the top surface. Applicator plate 420, again, is analogous to previously described second plates, but is referred to as an applicator plate to avoid confusion with upper plate 412. Applicator plate 420 has a centrally positioned, generally circular attachment fitting 422 extending down from the bottom side. Fitting 422 includes, at its bottom edge, a pair of opposed, laterally extending tabs 424 and 426.

To attach applicator A, fitting 422 is positioned over opening 414 in upper plate 412 and tabs 424 and 426 are aligned with cutouts 416 and 418, respectively. The bottom surface 440 of applicator plate 420 is lowered into contact with upper plate 412, with tabs 424 and 426 passing through the aligned cutouts 416 and 418. The applicator plate 420 is then rotated, about a quarter turn, to take tabs 424 and 426 out of alignment with cutouts 416 and 418. The tabs engage the bottom surface of upper plate 412 at the perimeter of opening 414. This quarter turn, key in lock arrangement, secures the applicator plate 420 to the base plate assembly B, which is threadedly attached to drive plate 51 of the operative part of the massage machine head assemblies. Cutouts 408 and 410 of base plate 402 allow the tabs to be positioned below the bottom surface of the upper plate 412. However, since cutouts 408 and 410 are slightly larger and slightly beveled, they permit enough laterally movement of the tabs to accommodate a one-quarter locking turn.

Regardless of the embodiment, the apparatus of the present disclosure solves several problems known to the art. The base plate is attached to the massage machine operative head. This only needs to be done once, since the design of the base plate allows it to be used with any configuration of the second plate or directly with a threaded applicator, without a second plate. The second plate, bearing an applicator, can quickly be attached to the head simply by contacting the second plate with the base plate so that the adherent secures the second plate to the base plate.

To effect a quick change, the user simply pulls the applicator with sufficient vertical force to overcome the adhering force between the opposed hook and loop fasteners and a replacement applicator then is easily attached by aligning the second plate of the new applicator with the first plate on the head and contacting them together until the adherent secures the applicator to the head. Alignment of the two plates is facilitated by the stud and opening arrangement of one illustrated embodiment. In any event, the novel apparatus eliminates the awkward, time-consuming steps of unscrewing the first applicator from the head, aligning the applicator and head threads, and then attaching the replacement applicator by screwing a fitting into the head.

It will be appreciated by those skilled in the art that changes and modifications of the attachment apparatus of the present disclosure may be made without departing from the scope of the appended claims. Therefore, the foregoing description and accompanying drawings are intended to be illustrative of various aspects of the broader disclosure, and should not be construed in a limiting sense.

What is claimed is:

1. Apparatus for the releasable attachment of an applicator to the operative head of a massage machine, comprising:

a first plate having a peripheral edge, a top surface, a bottom surface and a series of openings formed through the plate from the top surface to the bottom surface, said first plate having external threads on the bottom surface for threaded attachment to the operative head of the massage machine;

adherent on the top surface of the first plate;

a second plate having a peripheral edge positioned on the top surface of the first plate, the second plate having a peripheral edge, a top surface and a bottom surface and a series of studs on the bottom surface, said studs positioned to engage the openings in the first plate;

an applicator attached to the top surface of the second plate; and adherent on the bottom surface of the second plate for releasably engaging the adherent on the top surface of the first plate when the second plate is positioned on the top surface of said first plate, thereby releasably securing the applicator to the operative head of the massage machine.

2. The apparatus of claim 1 wherein the first plate further comprises internal threads formed centrally therein.

3. The apparatus of claim 1 wherein the first plate further comprises a series of indentions formed in the peripheral edge to facilitate gripping of the second plate for the attachment to or removal from the operative head of the massage machine.

4. The apparatus of claim 1 wherein the second plate further comprises internal threads at the top surface for the threaded engagement of the applicator.

5. The apparatus of claim 1 wherein the adherent on the bottom surface of the second plate extends around the bottom surface adjacent the peripheral edge.

6. The apparatus of claim 1 wherein the respective adherents are positioned on the respective plates adjacent the peripheral edge of each recited plate.

7. Apparatus for the releasable attachment of an applicator to the operative head of a massage machine, comprising:

a generally annular first plate including threads for threaded attachment to the operative head of the massage machine, the first plate including a series of openings formed therein;

a second plate positioned on the top surface of the first plate and releaseably attached to the first plate by hook and loop fastener, the second plate having the applicator attached at a top surface and including a series of depending studs on a bottom surface of the second plate so that the studs engage the openings in the first plate to appropriately align the respective plates and to resist dislodgement of the second plate from the first plate by eccentric forces generated during use.

8. The apparatus of claim 7 wherein the openings in the first plate are spaced at equal distances around the first plate.

9. The apparatus of claim 8 wherein the depending studs are spaced at equal distances around the second plate.

10. A method of attaching an applicator to the operative head of a massage machine comprising:

attaching a first plate to the head of the massage machine, said operative head having threads formed centrally therein, said first plate having a top surface and a bottom surface with a plurality of openings formed therethrough, a fitting at the bottom surface for the threaded attachment of the first plate to the operative head, and an adherent on the top surface;

attaching the applicator to the first plate, the applicator being attached to a second plate, the second plate having a top surface and a bottom surface with the applicator attached to the top, a plurality of studs depending from the bottom surface with each one of the plurality of studs positioned to engage one the plurality of openings in the first plate when the second plate is attached to the first plate, and an adherent on the bottom surface;

wherein the adherent on the top of the first plate and the adherent on the bottom of the second plate releaseably secure the second plate to the first plate and thereby releaseably attach the applicator to the operative head while the engagement of the plurality of openings by the plurality of studs resists dislodgement of the second plate from the first plate during use.

11. Apparatus for the releasable attachment of an applicator to the operative head of a massage machine, comprising:

a first plate having a top surface and a bottom surface, said first plate attached to the operative head of a massage machine at the bottom surface of the plate, said first plate having a plurality of openings formed therein;

a resilient diaphragm on the top surface of the first plate, said diaphragm having a plurality of openings formed therein and in alignment with the plurality of openings in the first plate;

an upper plate positioned on the top surface of the diaphragm, said upper plate having a plurality of openings therein and in alignment with the plurality of openings in the diaphragm;

an applicator plate having a top surface and a bottom surface with an applicator attached to the top surface thereof, said applicator plate including a plurality of depending buttons on the bottom surface, said plurality of buttons being in alignment with the openings formed in the upper plate, the diaphragm and the base plate, where introduction of the buttons through the openings in the diaphragm secure the applicator plate, with the applicator thereon, to the upper plate.

12. The apparatus of claim 11 wherein said diaphragm is constructed from a resilient rubber.

13. The apparatus of claim 11 wherein each button comprising said plurality of buttons further comprises a bulbous head for introduction through the openings formed in the diaphragm.

14. Apparatus for the releasable attachment of an applicator to the operative head of a massage machine, comprising:

a first plate having a top surface and a bottom surface, said first plate attached to the operative head of a massage machine at the bottom surface of the plate, said first plate having a substantially circular opening formed therein, with a first and a second cutout formed in a perimeter of the circular opening;

an upper plate attached to the top surface of the first plate, said upper plate having a substantially circular opening formed therein, with a first and second cut formed in a perimeter thereof and being in alignment with the first and second cutout, respectively, formed in the perimeter of the circular opening in the first plate, said first and second cutouts in the upper plate having a perimeter dimension less than the perimeter dimension of the first and second cut outs of the first plate;

an applicator plate having a top surface and a bottom surface with an applicator attached to the top surface thereof, said applicator plate including a centrally positioned fitting depending from the bottom surface, said fitting having a first laterally extending tab and a second laterally extending tab, wherein said fitting can be introduced through the circular opening in the upper plate and the first and second laterally extending tabs introduced through the first and second cutouts, respectively, of the upper plate such that rotating of the applicator plate moves the first and second tabs out of alignment with the first and second cutouts of the upper plate, thereby resisting vertical extraction of the applicator plate from the upper plate.

15. Apparatus for the releasable attachment of any existing applicator to the operative head of any existing massage machine, comprising:

a first plate having a top surface and a bottom surface, said first plate attached to the operative head of a massage machine at the bottom surface of the plate, wherein the first plate having a series of openings positioned around the plate;

a first adherent on the top surface of the first plate;

a second plate positioned on the top surface of the first plate, the second plate including a top surface and a bottom surface, the second plate having a series of studs positioned around the bottom surface of the plate, said studs being positioned to engage said openings in the first plate when the second plate is positioned on the top surface of the first plate;

an applicator attached to the top surface of the second plate; and a second adherent on the bottom surface of the second plate for releaseably engaging the first adherent on the top surface of the first plate when the second plate is positioned on the top surface of the first plate.

16. An applicator for attachment to the operative head of a massage machine for the direct application of vibratory, oscillatory, gyratory or percussive forces to the body of a subject, comprising:

an upper section disposed for direct contact with the body of the subject; and a plate at the bottom of the upper section, said plate having a bottom surface with an adherent on the bottom surface, said plate configured for attachment to a complementary plate on the operative head of the massage machine, said plate on the operative head of the massage machine having an adherent on a top surface, wherein attachment is effected by engagement of the respective adherents when the plate at the bottom of the upper section contacts the plate on the operative head of the massage machine, the plate at the bottom of the upper section further comprising a plurality of studs extending down from the bottom surface, the plurality of studs disposed to engage a plurality of openings in the plate on the operative head of the massage machine when the respective plates are in contact.

17. A device for attachment to an applicator to effect releasable attachment of the applicator to the operative head of a massage machine, comprising:

a plate having a top surface and a bottom surface, said top surface disposed for attachment to the bottom of the applicator; and an adherent on the bottom surface of said plate, said adherent disposed to contact and adhere to an adherent on an upper surface of a complementary plate attached to the operative head of the massage machine wherein contact between the respective plates effects attachment of the applicator to the operative head and separation of the respective plates allows for release of the applicator from the operative head, further comprising a plurality of studs extending from the bottom surface and disposed to engage a plurality of openings formed in the complementary plate attached to the operative head of the massage machine.

18. In a massage machine having a head assembly to which individual ones of a plurality of force transmitting applicators are intended for attachment, and an electrical device for providing power to the head assembly, the head assembly including an eccentric drive cam for moving a drive plate in a gyratory motion, and a drive plate having at least a first side and a second side, the drive plate being operatively connected to the head assembly along the first side thereof, the improvement which comprises a quick connect and disconnect system for attaching and removing the individual ones of the applicators to and from the head assembly, the system including:

a second plate having a top surface and a bottom surface, said second plate attached to the head assembly of the massage machine at the bottom surface of the second plate, the second plate having a series of openings formed in and positioned around the second plate;

a first adherent on the top surface of the second plate;

a third plate positioned on the top surface of the second plate, the third plate including a top surface and a bottom surface, the applicator being attached to the top surface of the third plate; and a second adherent on the bottom surface of the third plate including a series of studs positioned on the third plate, the studs being positioned to engage the openings in the second plate when the third plate is positioned on the top surface of the second plate.

19. Apparatus for the quick connection and quick releasable attachment of an applicator to a head assembly of a massage machine, the head assembly including a drive plate, comprising:

a first plate having a peripheral edge, a top surface, a bottom surface and external threads at the bottom surface for threaded attachment to the drive plate of the head assembly;

hook and loop fastener on the top surface of the first plate;

a second plate positioned on the top surface of the first plate, the second plate having a peripheral edge, a top surface and a bottom surface, the second plate including internal threads for the threaded attachment of an applicator;

an applicator attached to the top surface of the second plate; and hook and loop fastener on the bottom surface of the second plate for releaseably engaging the hook and loop fastener on the top surface of the first plate when the second plate is positioned on the top surface of the first plate, thereby providing for the quick connection and the quick releaseably securing of the applicator to the head assembly of the massage machine.

* * * * *